US005455608A

United States Patent [19]

Stewart et al.

[11] Patent Number: 5,455,608

[45] Date of Patent: Oct. 3, 1995

[54] PEN START UP ALGORITHM FOR BLACK AND COLOR THERMAL INK-JET PENS

[75] Inventors: Lowell Stewart, Poway; Edward D. Davis, Encinitas; Irene Williams, Escondido; Curt Behrend; Steven R. Card, both of San Diego, all of Calif.

[73] Assignee: Hewlett-Packard Company, Palo Alto, Calif.

[21] Appl. No.: 56,243

[22] Filed: Apr. 30, 1993

[51] Int. Cl.[6] ..... B41J 2/165

[52] U.S. Cl. ..... 347/23; 347/30; 347/33; 347/35; 347/19

[58] Field of Search ..... 347/14, 19, 22, 347/23, 30, 33, 35, 60

[56] References Cited

U.S. PATENT DOCUMENTS

| | | | |
|---|---|---|---|
| 4,791,435 | 12/1988 | Smith et al. | 347/17 |
| 4,853,717 | 8/1989 | Harmon et al. | 347/29 |
| 4,926,196 | 5/1990 | Mizoguchi et al. | 347/23 |
| 4,977,459 | 12/1990 | Ebinuma et al. | 347/23 |
| 5,103,244 | 4/1992 | Gast et al. | 347/33 |
| 5,164,748 | 11/1992 | Katayanagi et al. | 347/30 |

FOREIGN PATENT DOCUMENTS

| | | | |
|---|---|---|---|
| 63-224956 | 9/1988 | Japan | 347/23 |
| 63-221050 | 9/1988 | Japan | 347/19 |
| 4-269549 | 9/1992 | Japan | 347/19 |

*Primary Examiner*—Benjamin R. Fuller
*Assistant Examiner*—John E. Barlow, Jr.

[57] ABSTRACT

A process for start up of a thermal ink-jet printhead cartridge that includes a sequence of nozzle clearing procedures of increasing severity which are performed in sequence so long as some of the nozzles of the printhead fail to fire ink drops pursuant to ink firing pulses provided to the printhead or until all of the procedures have been performed.

11 Claims, 9 Drawing Sheets

FIG. 2
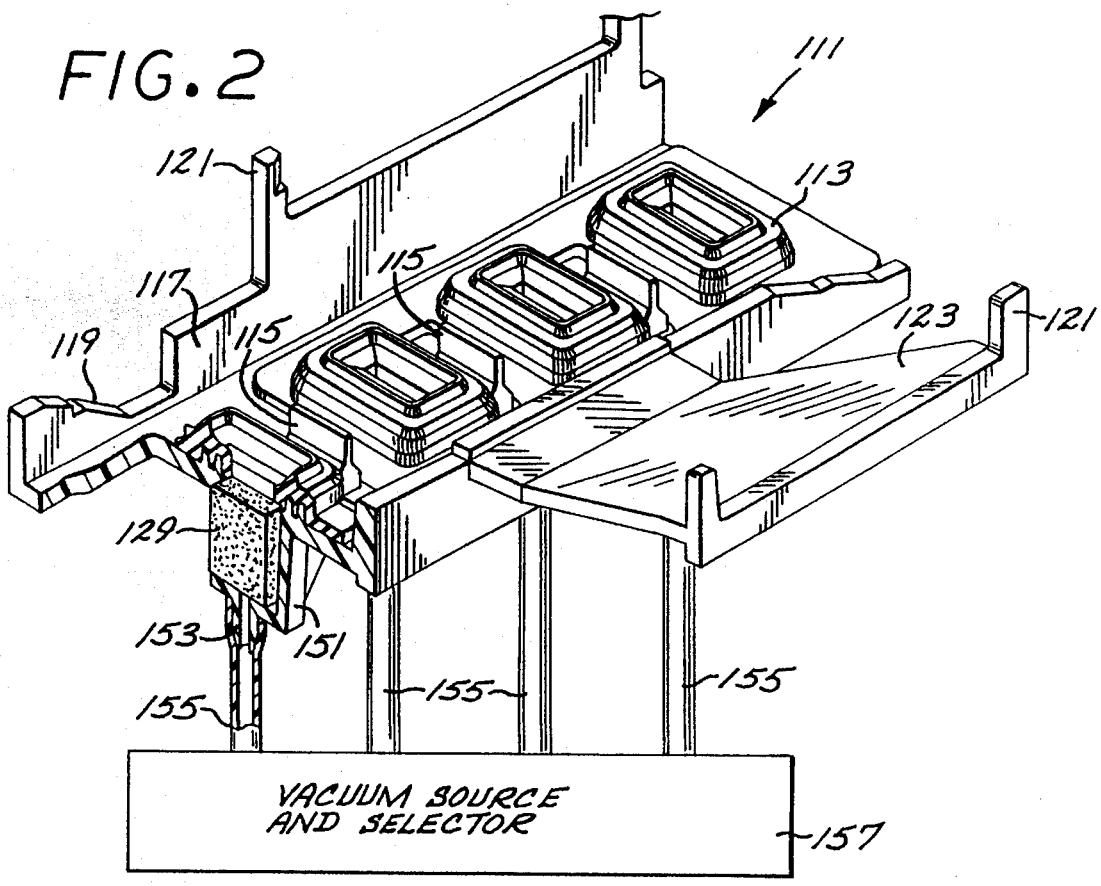
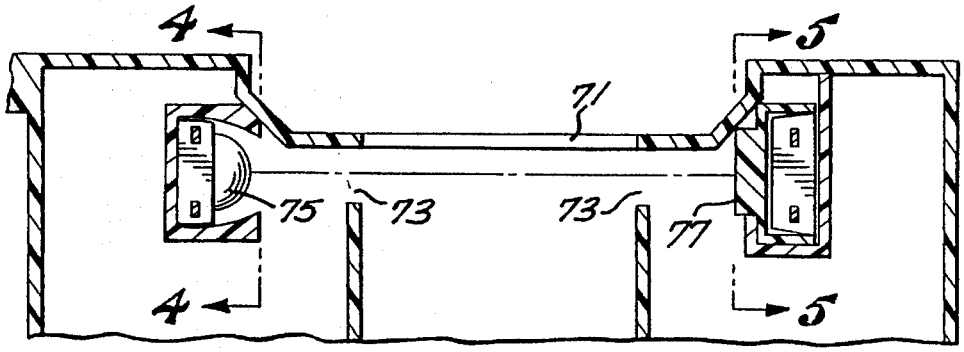
FIG. 3
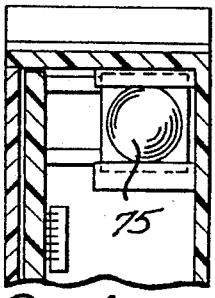
FIG. 4
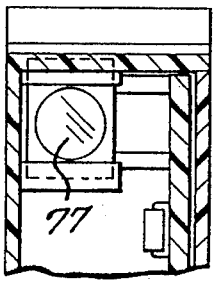
FIG. 5

PEN START UP ALGORITHM FOR BLACK AND COLOR THERMAL INK-JET PENS

BACKGROUND OF THE INVENTION

The subject invention is generally directed to thermal ink-jet printers, and more particularly to techniques for achieving reliable start up operation of thermal ink-jet pens.

An ink-jet printer forms a printed image by printing a pattern of individual dots at particular locations of an array defined for the printing medium. The locations are conveniently visualized as being small dots in a rectilinear array. The locations are sometimes "dot locations," "dot positions," or "pixels". Thus, the printing operation can be viewed as the filling of a pattern of dot locations with dots of ink.

Ink-jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

An important consideration with thermal ink-jet printers is improper operation due to clogged nozzles, particularly upon start up of a print operation after a printhead has not been used for some time. The presence of clogged nozzles prior to start up of a print operation cannot be visually detected, and thus the presence of clogged nozzles would be manifested by a bad printer output, which is wasteful since the subject matter intended to be printed would have to be printed again and moreover since the clogged nozzles would not necessarily have been cleared prior to the repeat print.

SUMMARY OF THE INVENTION

It would therefore be an advantage to provide an automatic thermal ink-jet printhead cartridge start up procedure for detecting clogged nozzles of a printhead cartridge prior to the start of a printing operation and clearing any detected clogged nozzles.

The foregoing and other advantages are provided by the invention in a printhead cartridge start up procedure that includes a sequence of nozzle clearing procedures of increasing severity which are performed in sequence so long as some of the nozzles of the printhead fail to fire ink drops pursuant to ink firing pulses provided to the printhead or until all of the procedures have been performed.

BRIEF DESCRIPTION OF THE DRAWINGS

The advantages and features of the disclosed invention will readily be appreciated by persons skilled in the art from the following detailed description when read in conjunction with the drawing wherein:

FIG. 2 is a schematic perspective view of the service station sled of the printer of FIG. 1.

FIG. 3 is a schematic cross-sectional view of the optical detector of the printer of FIG. 1.

FIG. 4 is a detail view of one of the optical elements of the optical detector of the printer of FIG. 1.

FIG. 5 is a detail view of the other optical element of the optical detector of the printer of FIG. 1.

DETAILED DESCRIPTION OF THE DISCLOSURE

Figure 1:
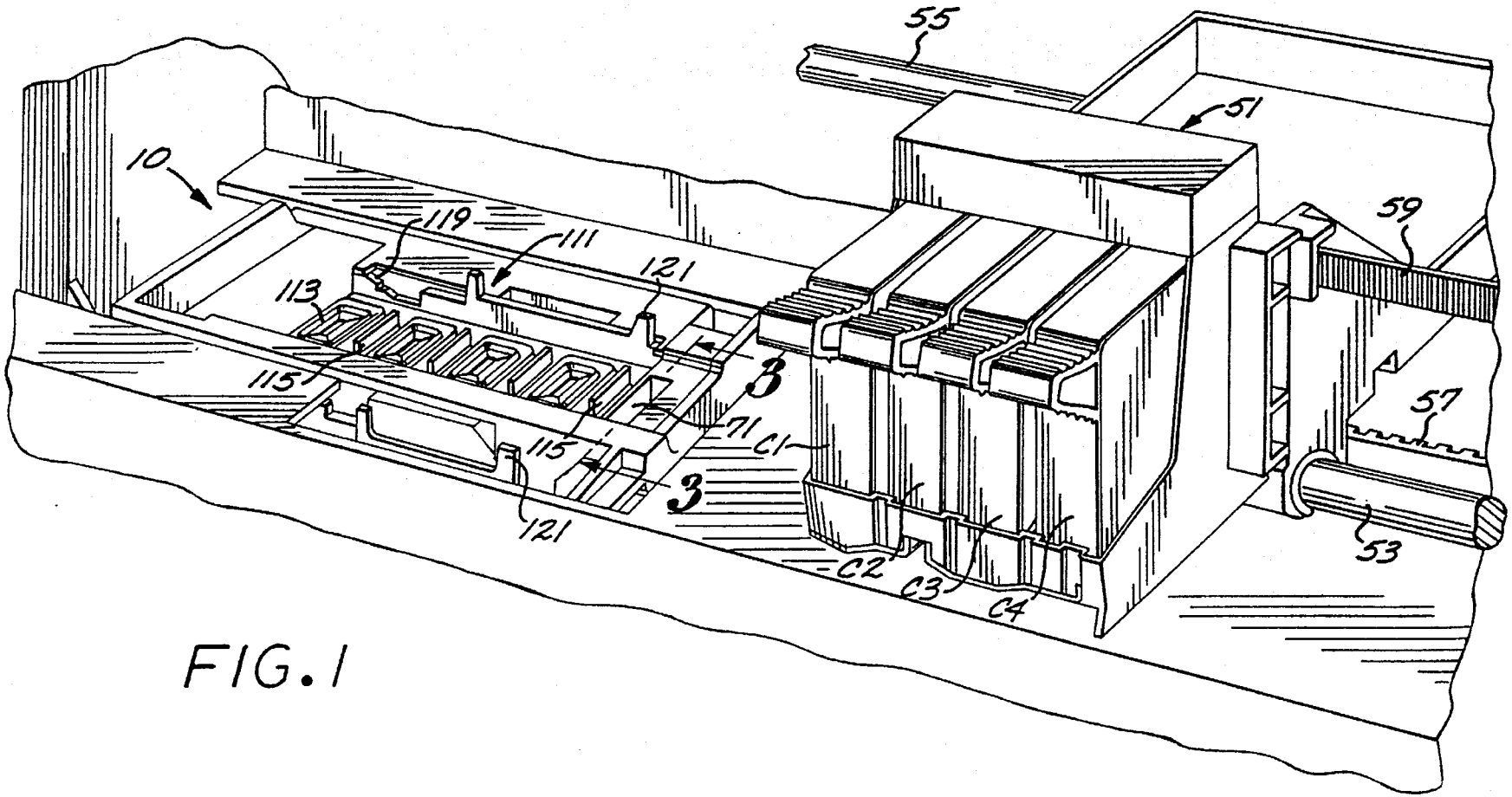
FIG. 1 is a schematic perspective view of the major mechanical components of a thermal ink-jet printer employing the disclosed thermal ink-jet printhead start up techniques.

In the following detailed description and in the several figures of the drawing, like elements are identified with like reference numerals.

Referring now to FIG. 1, set forth therein is a schematic frontal quarter perspective view depicting, by way of illustrative example, major mechanical components of a multiple printhead ink-jet printer in which the techniques of the invention can be implemented. The printer includes a movable carriage 51 mounted on guide rails 53, 55 for translational movement along the carriage scan axis (commonly called the Y-axis in the printer art). The carriage 51 is driven along the guide rails 53, 55 by an endless belt 57 which can be driven in a conventional manner, and a linear encoder strip 59 is utilized to detect position of the carriage 51 along the carriage scan axis, for example in accordance with conventional techniques.

The carriage 51 supports removable first through fourth ink-jet printhead cartridges C1, C2, C3, C4 (sometimes called "pens," "print cartridges," or "cartridges") which are side by side along the carriage axis. Each of the printhead cartridges C1, C2, C3, C4 includes a nozzle array comprised of a plurality of downwardly facing nozzles for ejecting ink generally downwardly to a print media which is supported on a print roller (not shown) that is generally below the printhead cartridges. In accordance with conventional thermal ink-jet printhead architecture, ink drops are fired from the nozzles pursuant to ink firing pulses applied to heater resistors respectively associated with the nozzles and located in the printhead interiorly of the nozzles.

For reference, the printhead cartridges C1, C2, C3, C4 are considered to be on the front of the printer, as indicated by legends on FIG. 1, while left and right directions are as viewed while looking toward the print cartridges, as indicated by labelled arrows on FIG. 1. By way of example, print media is advanced while printing or positioning so as to pass from beneath the cartridge nozzles toward the front of the printer, and is rewound in the opposite direction.

The media scan axis can be considered as being generally tangential to the print media surface that is below the nozzles of the printhead cartridges and orthogonal to the carriage scan axis. It is noted that the media scan axis is sometimes called the "vertical" axis, probably as a result of those printers having printing elements that printed on a portion of the print media that was vertical. Also, the carriage scan axis is sometimes called the "horizontal axis".

The printhead cartridges C1, C2, C3, C4 are side by side along the carriage scan axis and aligned along the media axis such that the nozzle arrays thereof are aligned along the media scan axis. By way of illustrative example, the cartridges C1, C2, C3 comprise non-black color printing cartridges for producing the base colors of yellow, cyan, and magenta as commonly utilized in color printing, while the cartridge C4 comprises a black printing cartridge.

The printer of FIG. 1 further includes a service station located to one side of the media print area and generally indicated by the reference numeral 10. The service station functions to cap the nozzle arrays of the printhead cartridges, wipe the nozzle arrays, and detect ink drops fired by the cartridges. The station more particularly includes a movable sled 111 that includes respective caps 113 configured to cap respective nozzle arrays of the cartridges when the carriage is moved into position over the caps 113. In particular, the caps 113 are designed to surround the printhead nozzle arrays rather than contact them, so as to reduce drying of ink. The caps 113 further function to convey priming vacuum to the nozzle arrays of the printhead cartridges. The movable sled 111 also includes resilient wipers 115 for wiping the nozzle arrays of the printhead cartridges as described more fully herein.

The movable sled 111 further includes vertical side panels 117 in front of and behind the caps 113, and cam surfaces 119 are formed in the side panels generally adjacent the distal caps. The cam surfaces 119 are mirror images of each other across a vertical plane that is parallel to the carriage axis. The sled also includes two vertically extending cam follower prongs 121 that formed on the front side panel between the cam surfaces 119, and two vertically extending cam follower prongs 121 on a forwardly extending panel 123. The cam following prongs 121 are mirror images of each other across a vertical plane that is parallel to the carriage axis. As shown more fully in FIGS. 11–16, vertical and horizontal movement of the sled 111 is controlled by engagement of the vertical prongs 121 by cam surfaces 233 and slots 231 in the carriage 51 and by the upward engagement of the cam surfaces 119 against stationary guides 237 pursuant to upwardly biasing springs 135. In particular, the cam surfaces 119 and the vertical prongs 121 of the sled, stationary guides 237 engaged with the cam surfaces 119, and the cam surfaces 233 and slots 231 of the carriage 51 that engage the vertical prongs 121 are configured such that the sled 111 is in its vertically highest position, called the capping position, when it is furthest from the print media (i.e., towards the left side of the printer), and is in its vertically lowest position, called the down position, when it is closest to the print media region (i.e., towards the center of the printer). In the capped position, the caps 113 of the sled 111 are in engagement with the nozzle arrays of the printhead cartridges, while in the down position the caps 113 and the wipers 115 are away from the path of the nozzle arrays. The carriage 51 and the sled 111 are configured such that wiping only takes place when the carriage moves to right after positioning the sled in the capping position pursuant to movement of the carriage to the left.

As shown in FIG. 2 for one of the caps 113, each cap 113 is secured to the top opening of a chamber 151 that extends downwardly and includes a lower port 153 that is connected to one end of a flexible tube 155 whose other end is connected to a vacuum source and selector unit 157 which is controlled to apply priming vacuum to a selected printhead nozzle array via the tube and chamber associated with the selected nozzle array. Each chamber 151 of the movable sled can contain a section of ink absorbing material, as generally indicated by the reference numeral 129 in FIG. 2, for absorbing ink suctioned from the nozzle array pursuant to priming. The vacuum source and selector unit 157 can comprise for example a vacuum pump and valve system as disclosed in commonly assigned U.S. application Ser. No. 07/949,318, filed Sep. 21, 1992, by William S. Osborne, for "AUTOMATIC FAILURE RECOVERY METHOD AND SYSTEM FOR INK-JET PRINTHEADS," incorporated herein by reference.

Referring again to FIG. 1, the service station includes a spittoon duct 71 into which ink drops can be fired and which serves as a baffle for the transmit and receiving elements of an optical drop detect circuit that is utilized to optically detect whether a selected nozzle is firing ink drops pursuant to application of ink firing pulses to the heater resistor associated with such selected nozzle. A reservoir (not shown) is located beneath the bottom opening of the spittoon duct. The spittoon duct 71 is rectangular in horizontal cross section, and optical elements of an optical detect circuit are secured outboard of apertures 73 formed in the opposing narrower walls of spittoon duct, as shown in FIGS. 3–5. In particular, an LED 75 is adjacent one aperture while a photodiode 77 is adjacent the other aperture. In operation, the LED 75 directs light toward the photodiode so as to form an optical detect zone inside the spittoon duct between the openings in the walls of the spittoon duct 71. The presence of an ink drop in the optical detect zone is indicated by reduction in the light detected by the photodiode 77.

Figure 6:
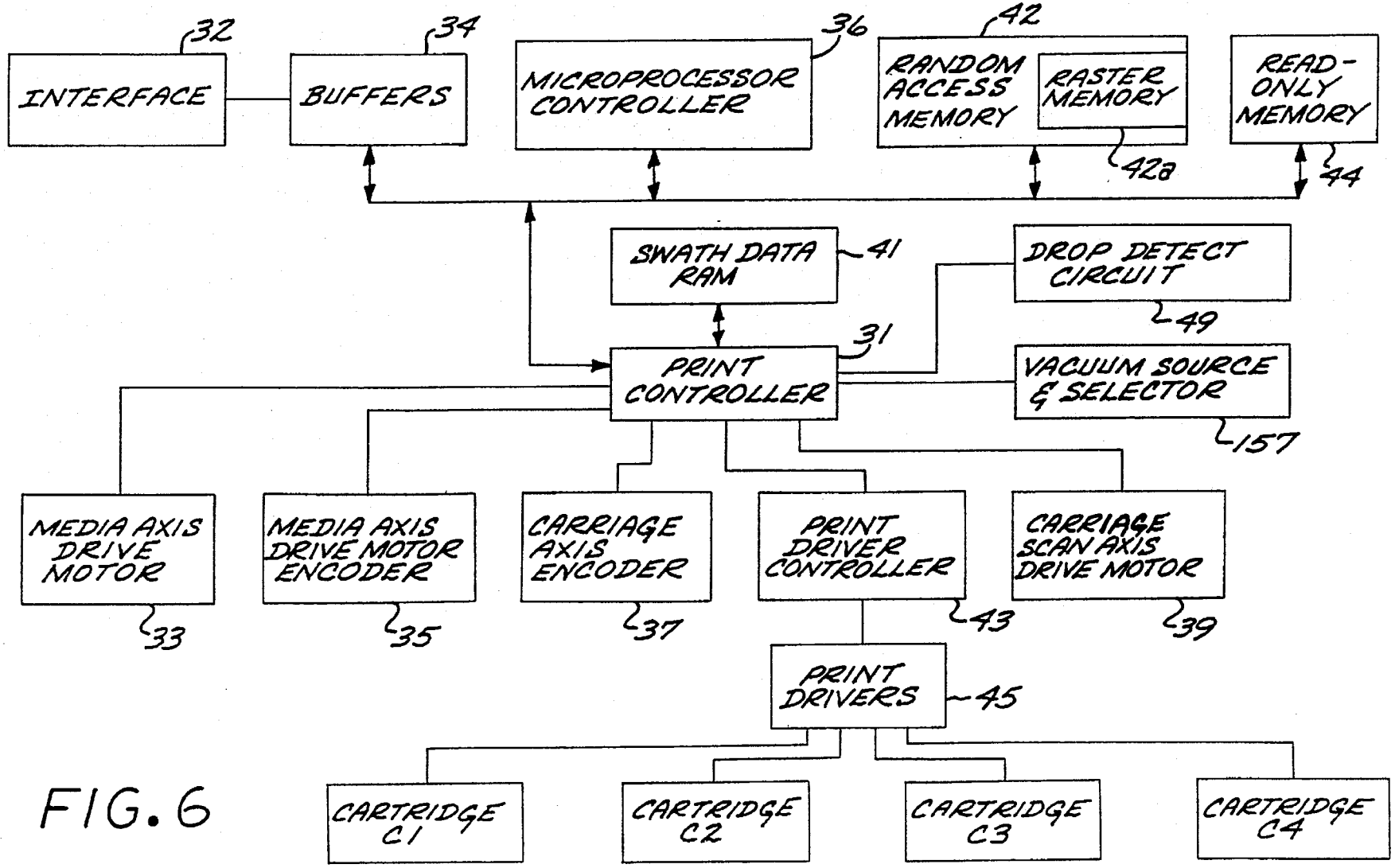
FIG. 6 is a simplified block diagram of a printer control system for controlling the swath printer of FIG. 1.

Referring now to FIG. 6, set forth therein is a simplified block diagram of a control system for controlling the thermal ink-jet printer of FIG. 1 in which the techniques of the invention can be implemented. The control system includes an interface 32 which receives print data from a host computer, for example, and stores the print data in a buffer memory 34. A microprocessor controller 36 is configured to process the print data to produce raster data that is stored in a bit-map memory **42*a* contained in a random access memory (RAM) 42 provided for the use of the microprocessor controller. A read-only memory 44 is also provided as appropriate for the use of the microprocessor controller 36**.

A print controller 31 transfers portions of the raster data from the bit-map memory 42a to a swath memory 41 and provides swath data to a printhead driver controller 43 which controls printhead drivers 45 that drive the ink firing heater resistors of the printhead cartridges Cl, C2, C3, C4. The print controller 31 further controls a media axis driver motor 33 which moves a print roller pursuant to media motion commands from the print controller 31. A media axis drive motor encoder 35 provides information for the feedback control of the media axis driver motor 33. Similarly, a carriage axis encoder 37 provides feedback information for the feedback control of a carriage scan axis drive motor 39 which positions the ink-jet cartridge supporting carriage 51 pursuant to carriage motion commands from the print controller 31. The print controller 31 further controls the operation of the vacuum source and selector unit 157, and receives the output of an optical drop detect circuit 49 that includes the optical elements mounted adjacent the spittoon duct 71.

An example of an optical drop detect circuit that can be utilized with the invention is disclosed in commonly assigned co-pending U.S. application 08/056,011, filed on Apr. 30, 1993, by Lowell Stewart, for "DROP DETECT CIRCUIT—2 COLOR," incorporated herein by reference.

Figure 7:
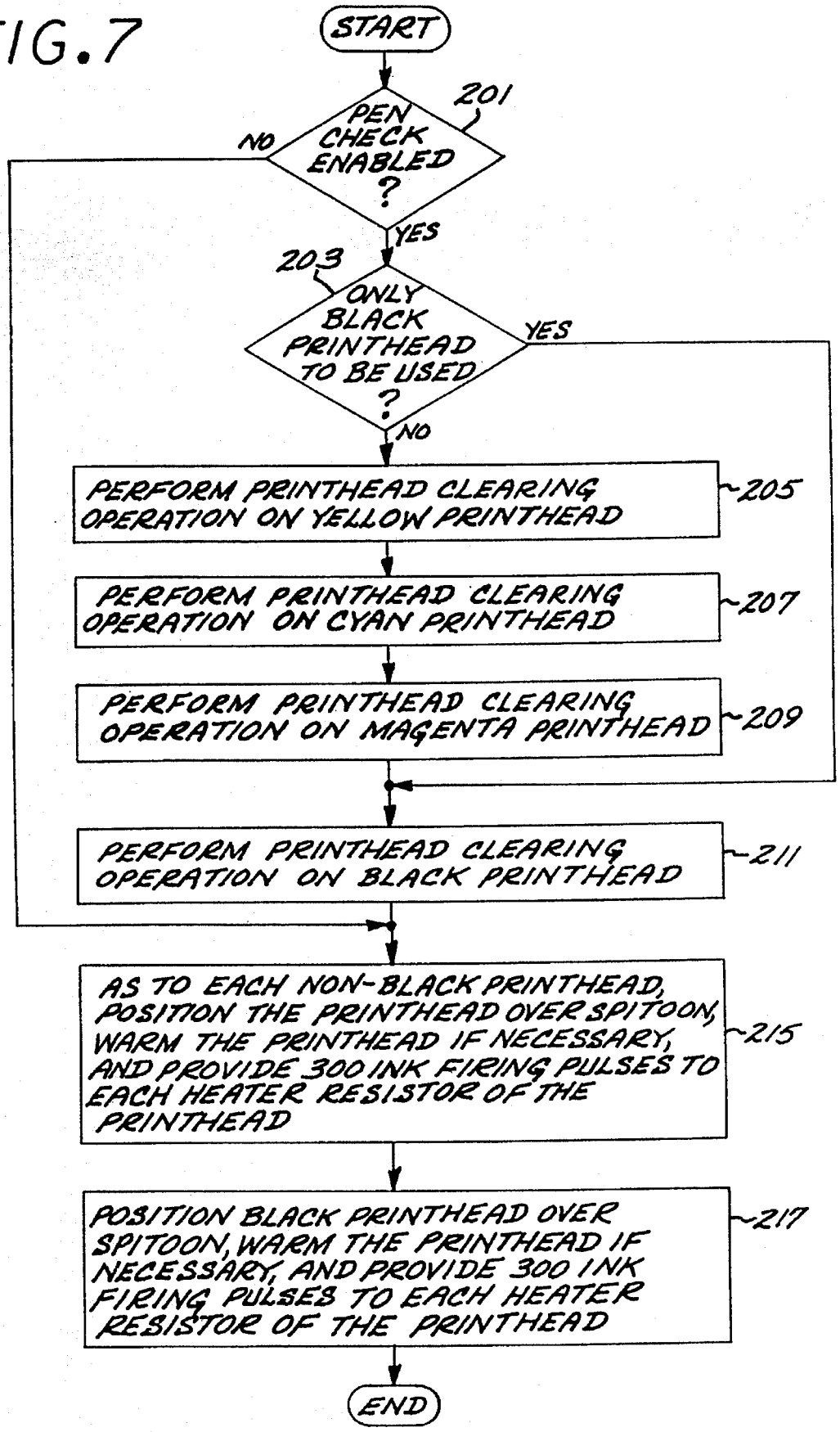
FIG. 7 sets forth a generalized flow diagram of a printhead start up process in accordance with the invention.

Referring now to FIGS. 7–10, set forth therein are flow diagrams of a process performed to start up the printheads C1, C2, C3, C4 in preparation for a scheduled print operation. FIG. 7 sets forth a generalized flow diagram of the start up process, while FIGS. 8–10 respectively set forth specific start up procedures performed on the cartridges. In the start up process, a printhead is driven with ink firing pulses to clear any air bubbles, viscous plugs, or contamination from nozzles. Depending upon the particular printhead implementation, clearing pulses can be more effective at clearing nozzles if the printhead is at a sufficiently high operating temperature (herein called the "nozzle clearing temperature") when the clearing pulses are applied. In such case, prior to application of clearing pulses to the printhead, the printhead temperature is checked, for example by reading a temperature sensor such as a thermal sense resistor in the printhead, and the printhead is warmed to a predetermined nozzle clearing temperature if necessary by application of non-nucleating warming pulses.

Referring in particular to FIG. 7, at 201 a determination is made as to whether a printer pen check is enabled, for example pursuant to the setting of a control switch. If yes, at 203 a determination is made as to whether the print operation for which start up is being performed will utilize only the black producing cartridge, for example for a monochrome output. If yes, at 205 a printhead clearing procedure is performed on the yellow printing cartridge, at 207 the printhead clearing procedure is performed on the cyan producing printhead, at 209 the printhead clearing procedure is performed on the magenta producing cartridge, and at 211 the printhead clearing procedure is performed on the black producing cartridge. At 215 each of the non-black printing printhead cartridges is individually positioned over the spittoon, warmed to the predetermined clearing temperature if necessary pursuant to application of non-nucleating warming pulses to each of the heater resistors of the printhead, and driven by application of 300 ink firing pulses to each of the heater resistors thereof. At 217 the black printing printhead cartridge is positioned over the spittoon, warmed to the predetermined clearing temperature if necessary pursuant to application of non-nucleating warming pulses to the heater resistors of the printhead, and driven by application 300 ink firing pulses each of the heater resistors thereof. The procedure then ends, and the printing procedure can commence.

The number of ink firing pulses and the pulse frequency utilized at steps 215 and 217 are based on the particular design of the printhead and the characteristics of the ink being utilized therewith. The intent is to maintain the nozzles in a cleared condition if nozzle clearing was performed pursuant to steps 205, 207, 209, and 211, or to provide some nozzle clearing if the nozzle clearing procedure was not performed.

Referring again to the determination at 203, if only the black producing printhead cartridge is to be used in the scheduled print operation, control transfers to 211. Referring further to the determination at 201, if there is no request for a printhead test control transfers to 215, described above.

Figure 8:
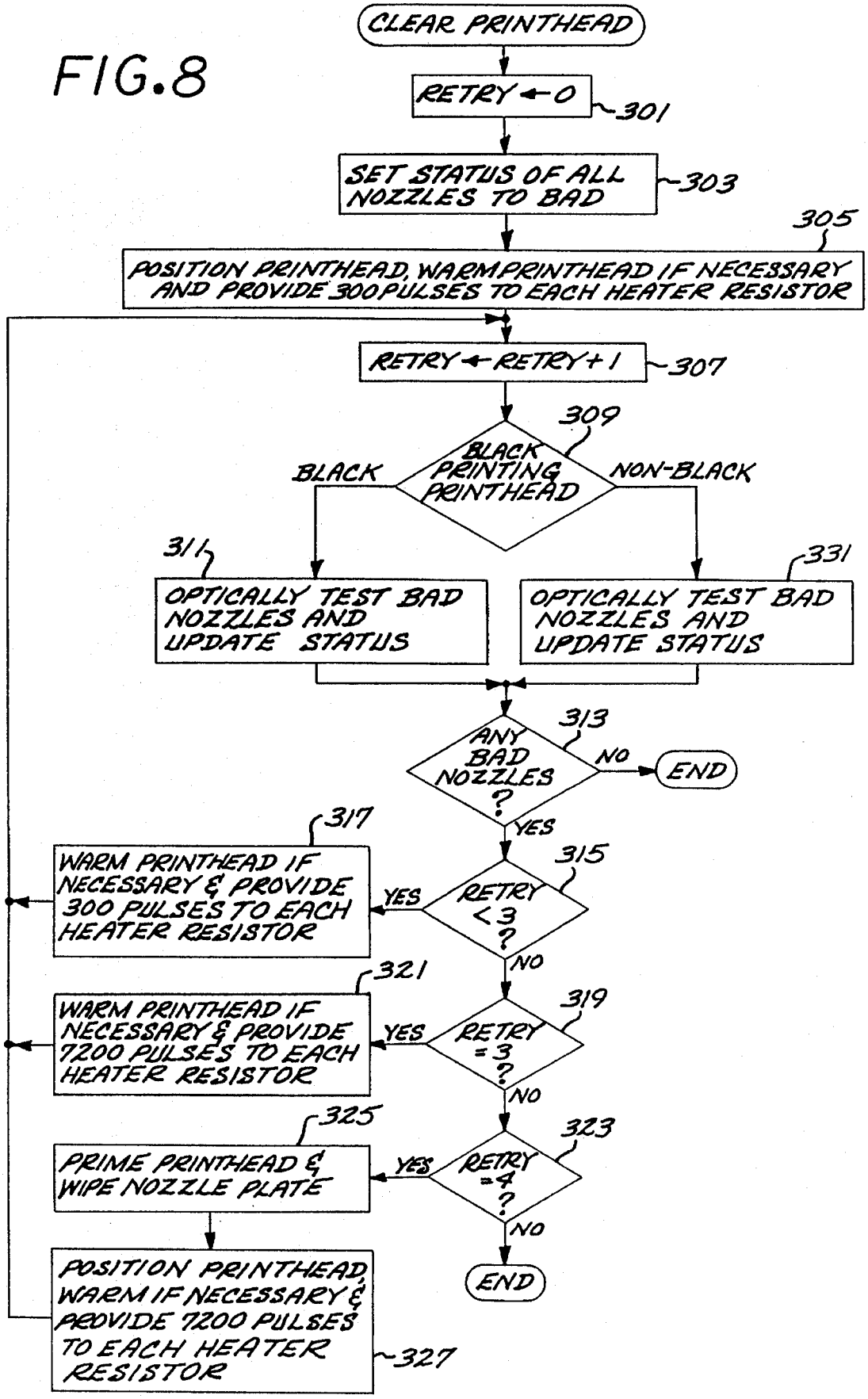
FIG. 8 sets forth a procedure that can be utilized for the steps of clearing a printhead nozzle array in the start up process of FIG. 7.

Referring now to FIG. 8, set forth therein is a flow diagram of the printhead clearing procedure performed at steps 205, 207, 209, 211 of the procedure of FIG. 7. At 301 a RETRY count is initialized to 0, and at 303 the status of each nozzle of the printhead is set to bad. At 305 the printhead is positioned over the spittoon, warmed to the clearing temperature if necessary pursuant to application of non-nucleating warming pulses, and driven by application of 300 ink firing pulses are provided to each heater resistor of the printhead. At 307 the RETRY count is incremented by 1, and at 309 a determination is made as to whether the printhead is a non-black producing printhead. If no (i.e., the printhead being tested is a black producing printhead), at 311 each nozzle whose status is bad is tested optically with the optical detector and the status of such bad nozzle is updated according to the result of the test. A procedure for optical testing and status updating of a black printing printhead is set forth in FIG. 9. At 313 a determination is made as to whether any of the nozzles are of the bad status. If yes, at 315 a determination is made as to whether RETRY is less than 3. If yes, at 317 the printhead is warmed to the predetermined clearing temperature if necessary pursuant to application of non-nucleating warming pulses and is driven by application of 300 ink firing pulses are provided to each of the heater resistors of the printhead, and control transfers to 307.

If the determination at 315 is no, at 319 a determination is made as to whether RETRY is equal to 3. If yes, at 321 the printhead is warmed to the predetermined clearing temperature and is driven by application of 7200 ink firing pulses to each of the heater resistors of the printhead, and control transfers to 307.

If the determination at 319 is no, at 323 a determination is made as to whether RETRY is equal to 4. If yes, at 325 the printhead is capped and primed and wiped. At 327 the printhead is returned to the spittoon, warmed to the clearing temperature if necessary pursuant to application of non-nucleating warming pulses, and driven by application of 7200 ink firing pulses to each of the heater resistors of the printhead. Control then transfers to 307.

If the determination at 323 is no, the procedure ends. A report of printhead cartridge failure can be provided if the procedure ends pursuant to a determination of no at 323 since that indicates that at least one nozzle is not firing and could not be cleared.

Referring again to the determination of 309, if the determination there is yes the printhead being tested is a non-black producing printhead, at 331 each nozzle whose status is bad is tested optically with the optical detector and the status of such bad nozzle is updated according to the result of the test. A procedure for optical testing and status updating of a non-black printhead cartridge is set forth in FIG. 10. Control then transfers to 313.

In the foregoing printhead nozzle clearing procedure, a series of different nozzle clearing operations are performed on the printhead until all nozzles are cleared, or until all operations have been performed. The operations increase in severity as to damage to the printhead and depletion of the ink supply of the cartridge, with the more severe operations being performed only if the less severe operations fail to unclog all of the nozzles of the printhead. The least severe clearing operation involves application of a limited number of ink firing pulses, such as the 300 pulses described above, to each of the printhead heater resistors. The limited number of pulses and the pulse frequency utilized is adjusted for the particular printhead design and ink formulation, and can be set for example by determining the number of pulses and the pulse frequency that will clear most printheads that are not severely clogged. The next operation of increased severity involves application of a much greater number of ink firing pulses, such as the 7200 pulses described above, to each of the printhead heater resistors. The limited number of pulses and the pulse frequency utilized is adjusted for the particular printhead design and ink formulation, and can be set for example by determining the number of pulses and the pulse frequency that will clear most printheads that are severely clogged. The most severe operation involves priming, wiping, and application of the greater number of ink firing pulses, and is utilized only for the most severely clogged printheads.

Figure 9:
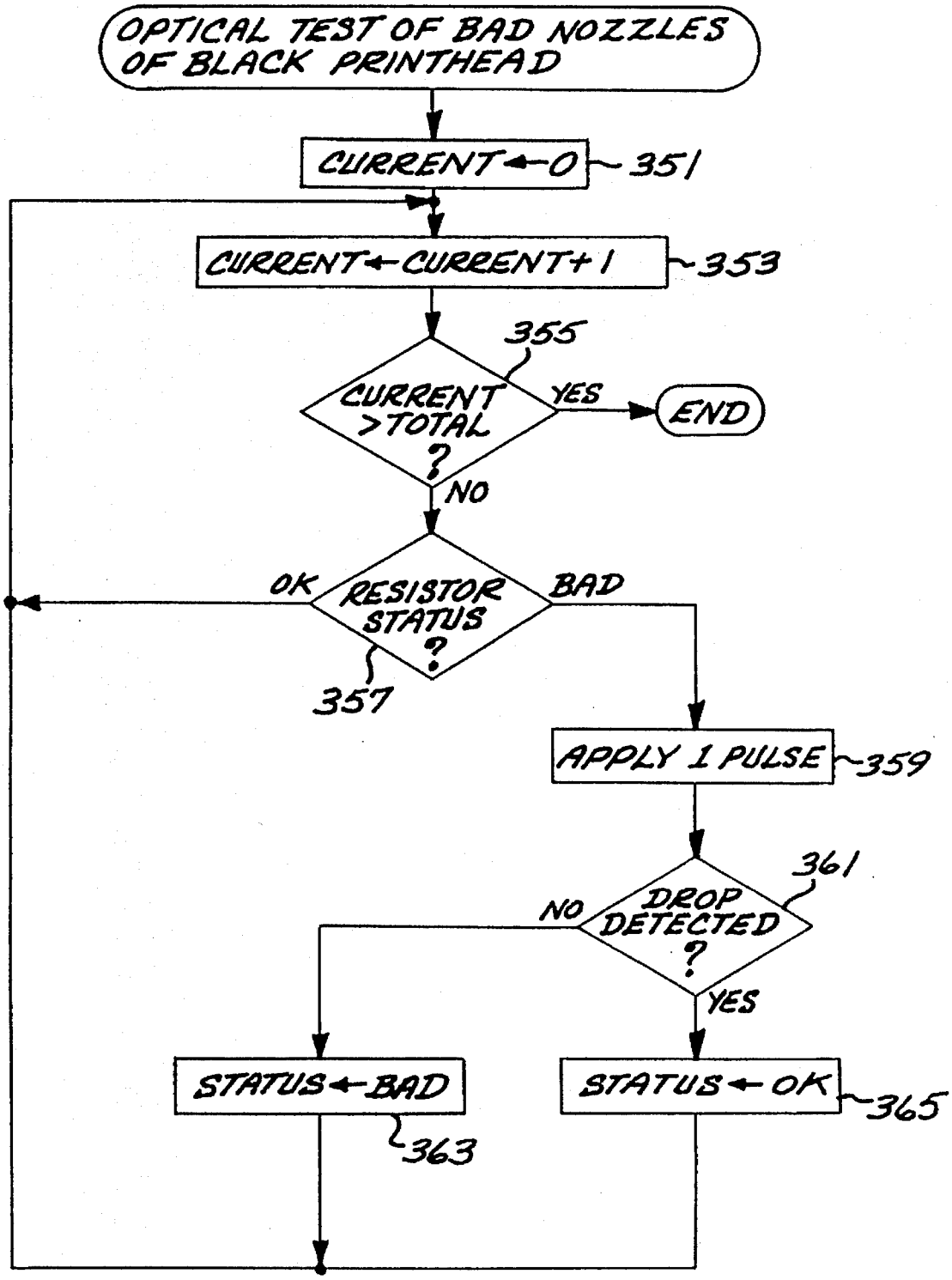
FIG. 9 sets forth a procedure that can be utilized for the step of optically testing the bad status nozzles of a black printing printhead in the procedure of FIG. 8.

Referring now to FIG. 9, set forth therein is a flow diagram of a procedure that can be utilized for optically testing the bad status nozzles of a black printing cartridge at block 311 in FIG. 8. At 351 a CURRENT nozzle select index is initialized to 0, and at 353 the CURRENT nozzle select index is incremented by 1. At 355 a determination is made as to whether the CURRENT nozzle select index is greater than the TOTAL number of nozzles being used in the printhead. If yes, the procedure ends. If the determination at 355 is no, at 357 the status of the CURRENT nozzle is checked. If the status of the CURRENT nozzle is good, control transfers to 353. If the status of the CURRENT nozzle is bad, at 359 an ink firing pulse is provided to the heater resistor of the CURRENT nozzle. At 361 a determination is made as to whether an ink drop was detected by the optical detector. If no, the status of the CURRENT nozzle is set to bad at 363, and control transfers to 353. If the determination at 361 is yes an ink drop was detected, the status of the CURRENT nozzle is set to good at 365, and control transfers to 353.

Figure 10:
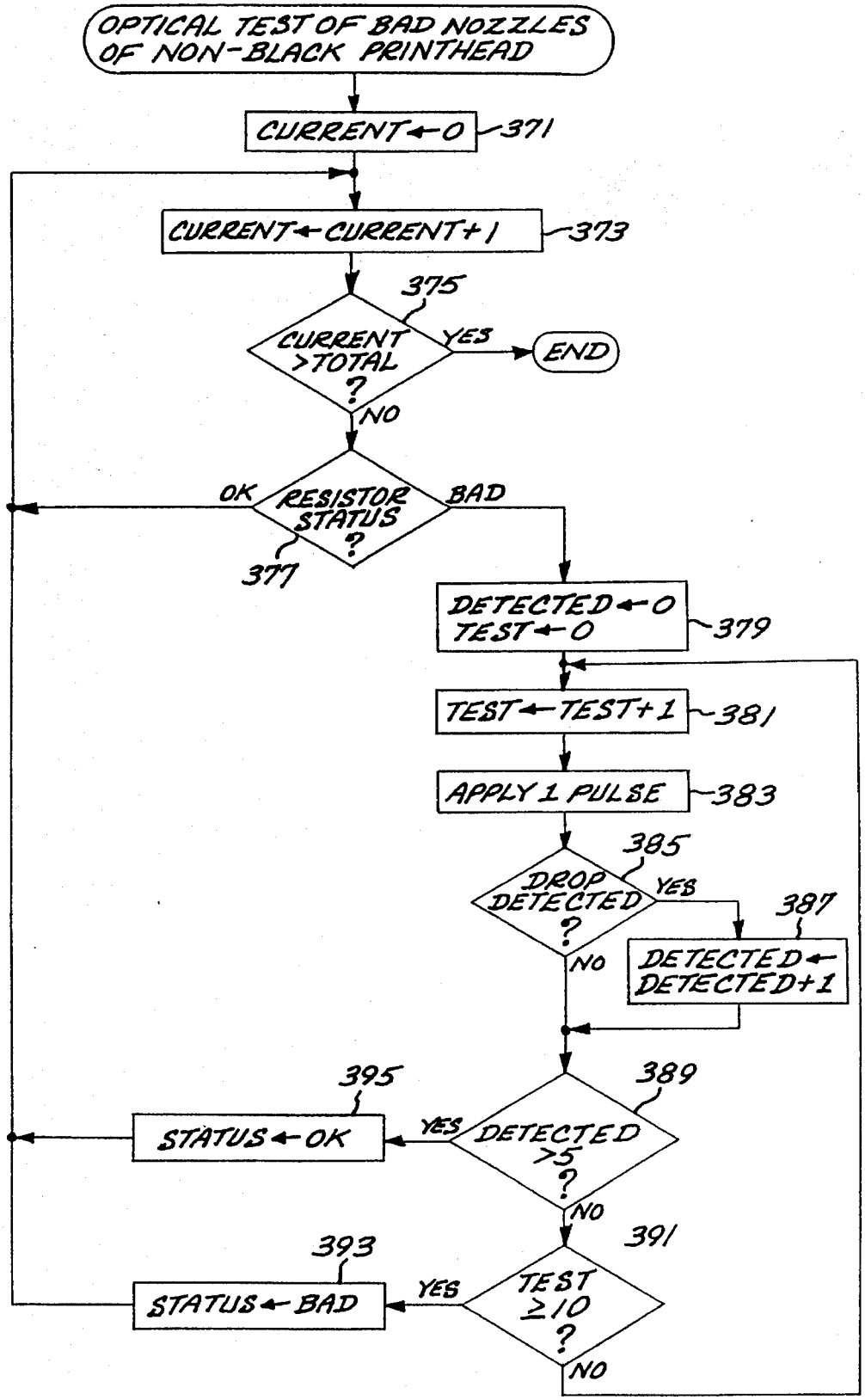
FIG. 10 sets forth a procedure that can be utilized for the step of optically testing the bad status nozzles of a non-black printing printhead in the procedure of FIG. 8.

Referring now to FIG. 10, set forth therein is a flow diagram of a procedure that can be utilized for optically testing the bad status nozzles of a non-black printing cartridge at block 331 in FIG. 8, for the illustrative implementation wherein the drops produced by the non-black printing printhead cartridges are smaller than the drops produced by the black printing printhead cartridge and not as reliably sensed by the drop detect circuit. At 371 a CURRENT nozzle select index is initialized to 0, and at 373 the CURRENT nozzle select index is incremented by 1. At 375 a determination is made as to whether the CURRENT nozzle select index is greater than the TOTAL number of nozzles being used in the printhead. If yes, the procedure ends. If the determination at 375 is no, at 377 the status of the CURRENT nozzle is checked. If the status of the CURRENT nozzle is good, control transfers to 373. If the status of the CURRENT nozzle is bad, at 379 a DETECTED drop count is set to 0 and a TEST count is set to 0. At 381 the TEST count is incremented by 1, and at 383 an ink firing pulse is provided to the heater resistor of the CURRENT nozzle. At 385 a determination is made as to whether an ink drop was detected by the optical detector. If yes, the DETECTED drop count is incremented by 1, and control transfers to 389. If the determination at 385 is no, an ink drop was not detected, at 389 a determination is made as to whether the DETECTED drop count is greater than 5. If no, at 391 a determination is made as to whether the TEST count is greater than or equal to 10. If no, control transfers to 381. If the determination at 391 is yes, at 393 the status of the CURRENT nozzle is set to bad, and control transfers to 373.

Referring again to 389, if the determination there is yes, at 395 the status of the CURRENT nozzle is set to good, and control transfers to 373.

In the procedure of FIG. 10, a determination of whether the bad nozzle is operational is based on a plurality of ink firing pulses so as to provide a more reliable detect/no detect determination. In particular, it is assumed that since the non-black drops are quite small, not all of the drops will be detected, and utilizing a plurality of ink firing pulses to detect the operation of a nozzle effectively averages the determination of nozzle operation over a plurality of ink firing pulses. For the specific implementation disclosed, a non-black printing nozzle is determined to be operational if 10 ink firing pulses result in 5 detected drops; i.e., an average of 50% detection over a sample of 10 ink firing pulses.

Figure 11:
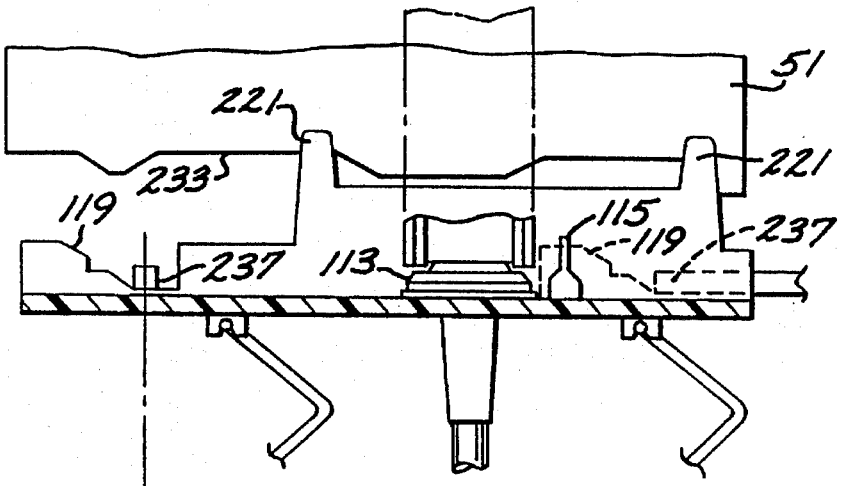
FIG. 11 is a schematic elevational view illustrating the sled of the printer of FIG. 1 in a capping position with printhead nozzle arrays capped by caps on the sled.
Figure 12:
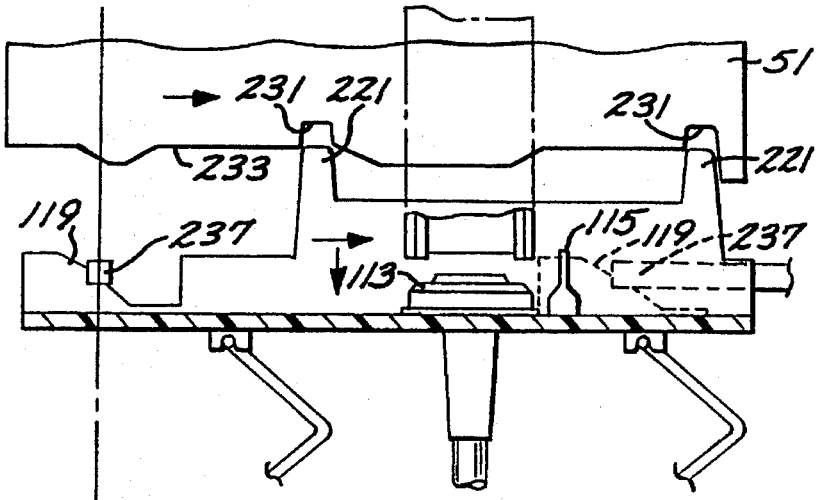
FIG. 12 is a schematic elevational view illustrating the sled of the printer of FIG. 1 as it is moved from the capping position by movement away from the capping location of the carriage that supports the printhead nozzle arrays.
Figure 13:
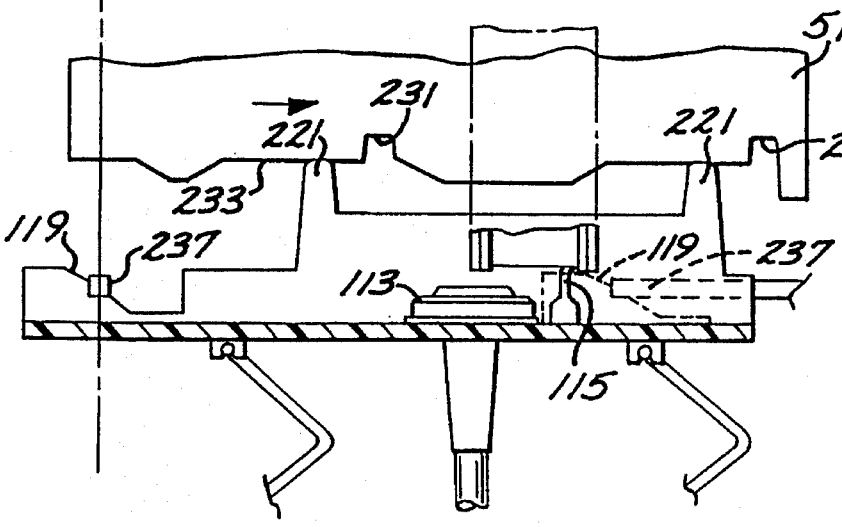
FIG. 13 is a schematic elevational view illustrating the sled of the printer of FIG. 1 in a stationary wiping position wherein printhead nozzle arrays move against wipers on the sled as the carriage continues to move away from the capping location.
Figure 14:
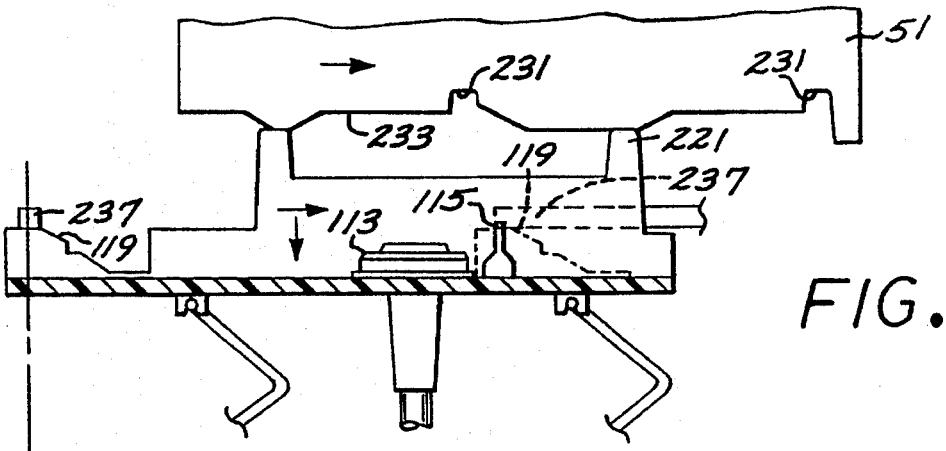
FIG. 14 is a schematic elevational view illustrating the sled of the printer of FIG. 1 as it is moved from the wiping position to the down position as the carriage continues to move away from the capping location after the printhead nozzle arrays have been wiped.
Figure 15:
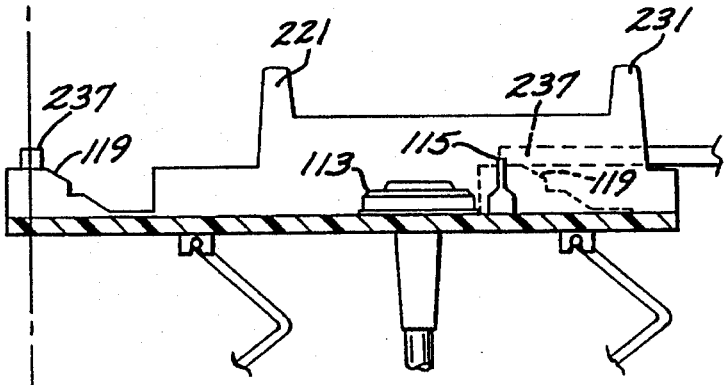
FIG. 15 is a schematic elevational view illustrating the sled of the printer of FIG. 1 in a stationary down position to which it has been moved pursuant to the continued movement of the carriage away from the capping location.
Figure 16:
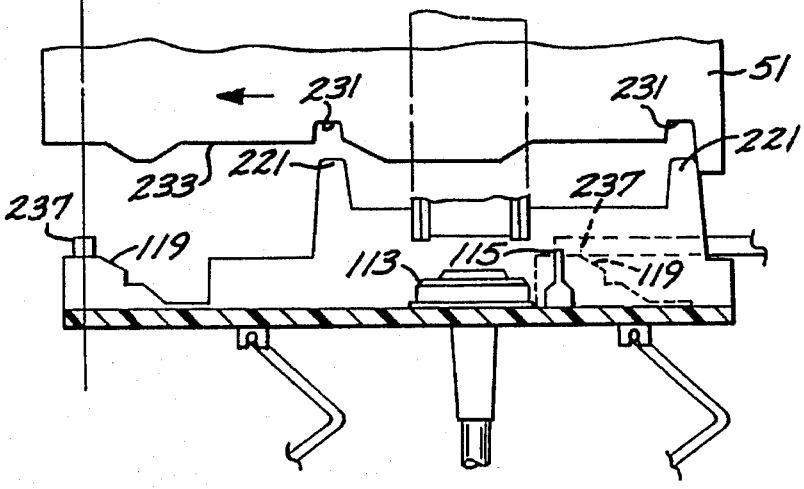
FIG. 16 is a schematic elevational view illustrating the sled of the printer of FIG. 1 as it is engaged by the carriage as the carriage moves toward the capping location.

Referring now to FIGS. 11–16, the sled 111 and the carriage 51 cooperate as follows to cap the nozzle arrays of the printhead cartridges and to wipe the nozzle arrays when the carriage moves away from engagement of the sled in the capped position. As shown in FIG. 11, when the sled is in the capping position, it is in its vertically highest position such that the caps 113 are in engagement with the printhead nozzle arrays that are overlying the caps as a result of movement of the carriage to the left to position the sled in the capping position. In the capping position, the prongs 121 of the sled are engaged in slots 231 of the carriage, and the lowest portion of the cam surfaces 119 are engaged against the stationary guides 237 pursuant to the upward bias of the sled by the springs 235. As the carriage is moved to the right toward the center of the printer, the sled is moved to the right by virtue of the prongs 121 being contained in the slots 231 of the carriage. As the sled is moved to the right, it is vertically lowered away from the printhead cartridges as sloped portions of the cam surfaces 119 slide across the stationary guides 237. Notches in the cam surfaces eventually engage the stationary guides 237, at which time the sled prongs 121 are clear of slots 231 in the carriage 51. As the carriage continues its movement to the right, the prongs 121 remain clear of the cam surfaces 233 of the carriage 51, and sled remains stationary while the nozzle arrays of the printhead cartridges slide over the resilient wipers 115. Continued movement of the carriage causes bumps in the cam surfaces 233 of the carriage 51 to engage the prongs 121 which causes the sled to move downward and to the right as the notches in the sled cam surfaces 119 disengage from the stationary guides 237 and sloped portions of the sled cam surfaces slide against the stationary guides. The downward and to the right movement of the sled continues until horizontal portions of the sled cam surfaces become engaged with the stationary guides 237 at which time the prongs 121 are clear of the bumps in the carriage cam surfaces 233. The sled is then in its down position wherein the upper edges of the wipers are vertically lower than the printhead nozzle arrays.

The sled is moved to the capping position pursuant to engagement of the prongs 121 by the carriage slots 231 as the carriage moves to the left. Since the sled is in the down position, the printhead nozzle arrays remain higher than the wipers until the carriage slots engage the prongs 121, at which time the printhead nozzle arrays are positioned over the caps 113. Continued movement of the carriage to the left causes the sled to move up and to the left with the carriage as the sled cam surfaces 119 slide across the stationary guides 237. Eventually, the caps come into engagement with the printhead nozzle arrays, with the alignment between the nozzle arrays and the caps being controlled by the relative positioning of the slots 231 of the carriage and the prongs 121 of the sled 111.

More specific information as to the operation of the sled 111 relative to the carriage 51 is more particularly described in commonly assigned copending U.S application Ser. No. 08/056,327, filed Apr. 30, 1993, by Heinz Waschhauser and William Osborne for "SERVICE STATION HAVING REDUCED NOISE, INCREASED EASE OF ASSEMBLY AND VARIABLE WIPING CAPABILITY" , which is incorporated herein by reference; and in commonly assigned copending U.S application Ser. No. 07/949,197, filed Sep. 21, 1992, by William S. Osborne for "INK-JET PRINTHEAD CAPPING AND WIPING METHOD AND APPARATUS," which is also incorporated herein by reference.

Although the foregoing has been a description and illustration of specific embodiments of the invention, various modifications and changes thereto can be made by persons skilled in the art without departing from the scope and spirit of the invention as defined by the following claims.

What is claimed is:

1. A method for start up of a printhead cartridge of a thermal ink-jet printer, the printhead cartridge having a plurality of ink jet nozzles and heater resistors respectively associated therewith, the method comprising the steps of:

(A) performing a first nozzle clearing procedure on the printhead cartridge;

(B) optically testing each of said nozzles to determine whether lack of said nozzles is non-operational;

(C) if any nozzles are determined to be non-operational pursuant to the optical testing performed in step (B), performing a second nozzle clearing procedure that is more severe as to damage to the printhead cartridge than the first nozzle clearing procedure, and repeating step (B); and (D) if any nozzles are determined to be non-operational pursuant to the optical testing performed in step (B) as repeated pursuant to step (C), performing a third nozzle clearing procedure that is more severe as to damage to the printhead cartridge than the second nozzle clearing procedure.

2. The method of claim 1 wherein the first nozzle clearing procedure includes the step of driving each of the heater resistors with a first predetermined number of clearing pulses.

3. The method of claim 2 wherein the second nozzle clearing procedure includes the step of driving each of the heater resistors with a second predetermined number of clearing pulses which is greater than the first predetermined number of clearing pulses.

4. The method of claim 3 wherein the third nozzle clearing procedure includes the steps of:

priming the printhead; and driving each of the heater resistors with a plurality of clearing pulses.

5. The method of claim 3 wherein the third nozzle clearing procedure includes the steps of:

priming the printhead;

wiping the nozzle array of the printhead; and driving each of the heater resistors with a plurality of clearing pulses.

6. A method for start-up of a printhead cartridge of a thermal ink-jet printer, the printhead cartridge having a plurality of ink jet nozzles and heater resistors respectively associated therewith, the method comprising the steps of:

(A) checking whether a temperature of the printhead is at least as high as a predetermined clearing temperature, warming the printhead to the predetermined clearing temperature if necessary, and driving each of the heater resistors with a first predetermined number of clearing pulses;

(B) designating all nozzles as bad nozzles;

(C) optically testing each of said bad nozzles to determine whether it is operational, and designating an operational bad nozzle as a good nozzle;

(D) if any nozzles are determined to be bad pursuant to the optical testing performed in step (C), repeating step (A), and repeating step (C);

(E) if any nozzles are determined to be bad pursuant to the optical testing performed in step (C) as repeated pursuant to step (D), repeating step (A), and repeating step (C);

(F) if any nozzles are determined to be bad pursuant to the optical testing performed in step (C) as repeated pursuant to step (E), checking whether the temperature of the printhead is at least as high as the predetermined clearing temperature, warming the printhead to the predetermined clearing temperature if necessary, and driving each of the heater resistors with a second predetermined number of nozzle clearing pulses, wherein the second predetermined number of clearing pulses is greater than the first predetermined number of clearing pulses; and (G) if any nozzles are determined to be bad pursuant to the optical testing performed in step (C) as repeated pursuant to step (F), performing the following:

(1) priming the printhead;

(2) wiping the nozzle array of the printhead; and (3) checking whether the temperature of the printhead is at least as high as the predetermined clearing temperature, warming the printhead to the predetermined clearing temperature if necessary, and driving each of the heater resistors with the second predetermined number of nozzle clearing pulses, wherein the second predetermined number of clearing pulses is greater than the first predetermined number of clearing pulses.

7. The method of claim 6 wherein the step of optically testing each bad nozzle includes the steps of:

(a) applying an ink firing test pulse to the heater resistor of the bad nozzle;

(b) optically detecting whether an ink drop was produced by the bad nozzle pursuant to the ink firing test pulse;

(c) repeating steps (a) and (b) until one of the following conditions occurs:

(1) steps (a) and (b) have been repeated M times, where M is a non-zero integer; or (2) N drops have been detected pursuant to step (b) where N is a non-zero integer that is less than M;

(d) designating the bad nozzle as an operational nozzle if the repetition of steps (a) and (b) is stopped pursuant to the detection of N drops.

8. The method of claim 7 wherein the integer M is 2 times the integer N.

9. A method for start up of a printhead cartridge of a thermal ink-jet printer, the printhead cartridge having a plurality of ink-jet nozzles and heater resistors respectively associated therewith, the method comprising the steps of:

(A) driving each of the heater resistors with a first predetermined number of clearing pulses;

(B) designating all nozzles as bad nozzles;

(C) optically testing each of said bad nozzles to determine whether it is operational, and designating an operational of said bad nozzles as a good nozzle;

(D) if any nozzles are determined to be bad pursuant to the optical testing performed in step (C), repeating step (A) and repeating step (C);

(E) if any nozzles are determined to be bad pursuant to the optical testing performed in step (C) as repeated pursuant to step (D), repeating step (A), and repeating step (C);

(F) if any nozzles are determined to be bad pursuant to the optical testing performed in step (C) as repeated pursuant to step (E), driving each of the heater resistors with a second predetermined number of nozzle clearing pulses, wherein the second predetermined number of clearing pulses is greater than the first predetermined number of clearing pulses; and (G) if any nozzles are determined to be bad pursuant to the optical testing performed in step (C) as repeated pursuant to step (F), performing the following:

(1) priming the printhead;

(2) wiping the nozzle array of the printhead; and (3) driving each of the heater resistors with the second predetermined number of nozzle clearing pulses, wherein the second predetermined number of clearing pulses is greater than the first predetermined number of clearing pulses.

10. The method of claim 9 wherein the step of optically testing each bad nozzle includes the steps of:

(a) applying an ink firing test pulse to the heater resistor of the bad nozzle;

(b) optically detecting whether an ink drop was produced by the bad nozzle pursuant to the ink firing test pulse;

(c) repeating steps (a) and (b) until one of the following conditions occurs:

(1) steps (a) and (b) have been repeated M times, where M is a non-zero integer; or (2) N drops have been detected pursuant to step (b) where N is a non-zero integer that is less than M;

(d) designating the bad nozzle as an operational nozzle if the repetition of steps (a) and (b) is stopped pursuant to the detection of N drops.

11. The method of claim 10 wherein the integer M is 2 times the integer N.

* * * * *